US009630309B2

(12) United States Patent
Su et al.

(10) Patent No.: US 9,630,309 B2
(45) Date of Patent: Apr. 25, 2017

(54) HANDLE BODY FOR PNEUMATIC TOOL

(71) Applicant: BASSO INDUSTRY CORP., Taichung (TW)

(72) Inventors: San-Yih Su, Taichung (TW); Da-Jie Lin, Taichung (TW)

(73) Assignee: Basso Industry Corp., Taichung (TW)

( * ) Notice: Subject to any disclaimer, the term of this patent is extended or adjusted under 35 U.S.C. 154(b) by 824 days.

(21) Appl. No.: 13/905,332

(22) Filed: May 30, 2013

(65) Prior Publication Data

US 2013/0319713 A1 Dec. 5, 2013

(30) Foreign Application Priority Data

Jun. 1, 2012 (TW) ..... 101119786 A

(51) Int. Cl.
*B25F 5/02* (2006.01)
*B25B 21/00* (2006.01)

(52) U.S. Cl.
CPC ..... *B25F 5/02* (2013.01); *B25B 21/004* (2013.01)

(58) Field of Classification Search
CPC . B25B 21/004; B25B 21/005; B25B 23/0078; B25F 5/00
USPC ..... 173/218, 168; 81/57.13
See application file for complete search history.

(56) References Cited

U.S. PATENT DOCUMENTS 6,578,643 B2 * 6/2003 Izumisawa ..... B25B 21/004 173/104
6,640,669 B2 11/2003 Izumisawa
8,051,746 B2 * 11/2011 Bouchard ..... B25B 21/004 81/57.39
2002/0117028 A1 8/2002 Kusama

FOREIGN PATENT DOCUMENTS

| | | | |
|---|---|---|---|
| CN | 201419372 | Y | 3/2010 |
| TW | 494053 | B | 7/2002 |
| TW | 200603951 | A | 2/2006 |
| TW | M345679 | U | 12/2008 |
| TW | M417233 | U1 | 12/2011 |
| TW | I358344 | B1 | 2/2012 |

* cited by examiner

*Primary Examiner* — Robert Long
*Assistant Examiner* — Xavier A Madison
(74) *Attorney, Agent, or Firm* — McNees Wallace & Nurick LLC

(57) ABSTRACT

A pneumatic tool includes a handle body, an output unit having a driving head, a driving unit for driving the output unit, and a switching unit operable to change the rotational direction of the driving head. The handle body includes: a surrounding wall having a top surface and an axial space that has a central axis and that is adapted to permit the driving unit to be mounted therein; a mounting unit disposed at the top surface of the surrounding wall and adapted to permit the switching unit to be mounted therein; and a through hole formed vertically through the surrounding wall and in spatial communication with the axial space, the through hole being adapted to permit the output unit to be mounted therein.

7 Claims, 7 Drawing Sheets

HANDLE BODY FOR PNEUMATIC TOOL

CROSS-REFERENCE TO RELATED APPLICATION

This application claims priority of Taiwanese Application No. 101119786, filed on Jun. 1, 2012.

BACKGROUND OF THE INVENTION

1. Field of the Invention

The invention relates to a pneumatic tool, and more particularly to a handle body for a pneumatic tool.

2. Description of the Related Art

Referring to FIG. 1, a conventional pneumatic tool 1 includes a front handle section 11 and an output unit 12. The front handle section 11 has an axial hole 111 extending along a central axis (X), a through hole 112 formed through the front handle section 11 along a direction perpendicular to the central axis (X), and a generally U-shaped opening 113 formed in a front end of the front handle section 11. A driving unit (not shown) is mounted into the axial hole 111 through the opening 113. The output unit 12 is mounted into the through hole 112 through the opening 113.

However, since the output unit 12 mounted within the through hole 112 applies a pressure to a wall of the front handle section 11 defining the opening 112 in a direction perpendicular to the central axis (X), if the front handle section 11 is rotated during work operation, the opening 113 may become larger, thereby shortening the service life of the pneumatic tool 1 and reducing the structural stability of the pneumatic tool 1.

FIG. 2 shows a pneumatic ratchet drive wrench disclosed in U.S. Pat. No. 6,578,643. The pneumatic ratchet drive wrench includes a front handle section 21, an output unit 22, a driving unit 23, and a cover plate 24. The front handle section 21 is formed with a chamber 211 that is opened downwardly. The output unit 22 is disposed within the chamber 211, and has a driving head 221 extending along a vertical axis (Z). The driving unit 23 is also disposed within the chamber 211 for driving the output unit 22. The cover plate 24 is secured to a bottom surface of the front handle section 21 for covering the chamber 211, and has a through hole 241 permitting the driving head 221 to extend therethrough.

Although the front handle section 21 is not formed with a U-shaped opening, it is necessary to form a plurality of fastener holes 242 in the cover plate 24 to allow the cover plate 24 to be secured to the front handle section 21 by lock bolts . As such, high precision is required for forming the through hole 241 and the fastener holes 242 in the cover plate 24. Furthermore, in such a configuration, at least one partition needs be disposed in the front handle section 21 for forming at least two irregular-shaped chambers to position rotating and moving components within the front handle section 21, thereby resulting in difficulties in manufacturing and assembling the pneumatic ratchet drive wrench.

SUMMARY OF THE INVENTION

Therefore, an object of the present invention is to provide a pneumatic tool with a handle body that can overcome the aforesaid drawbacks associated with the prior art.

According to the present invention, a pneumatic tool includes a handle body, an output unit having a driving head, a driving unit for driving the output unit, and a switching unit operable to change the rotational direction of the driving head. The handle body includes: a surrounding wall having a top surface and an axial space that has a central axis and that is adapted to permit the driving unit to be mounted therein; a mounting unit disposed at the top surface of the surrounding wall and adapted to permit the switching unit to be mounted therein; and a through hole formed vertically through the surrounding wall and in spatial communication with the axial space, the through hole being adapted to permit the output unit to be mounted therein.

As such, this invention is advantageous in that, there is no need to form a U-shaped opening for permitting the output unit and the driving unit to be mounted into the handle body therethrough, or a chamber for receiving the output unit and the driving unit, so that the drawbacks associated with the prior art are eliminated.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
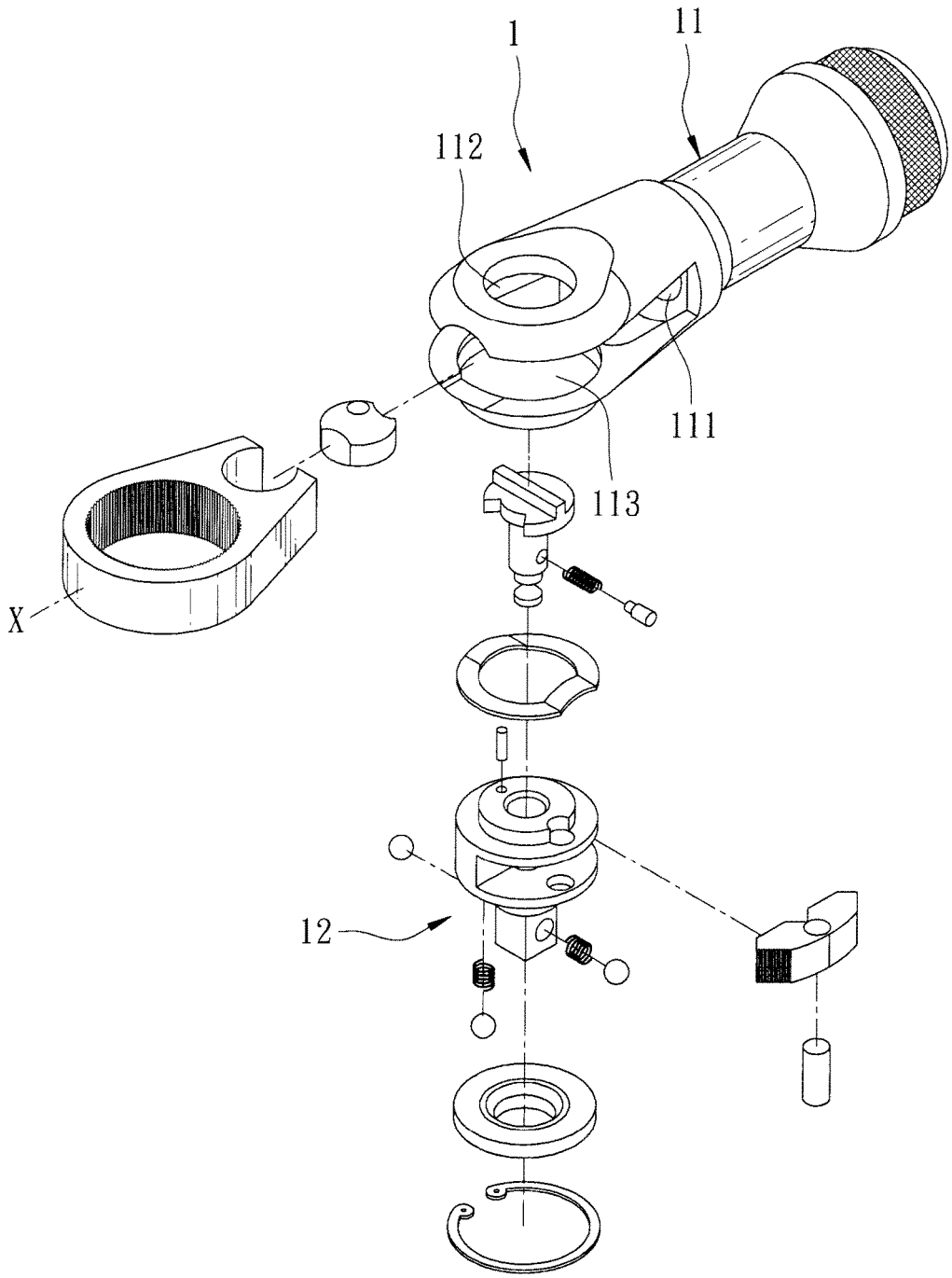
FIG. 1 PRIOR ART
FIG. 1 is a fragmentary exploded top perspective view of a conventional pneumatic tool.
Figure 2:
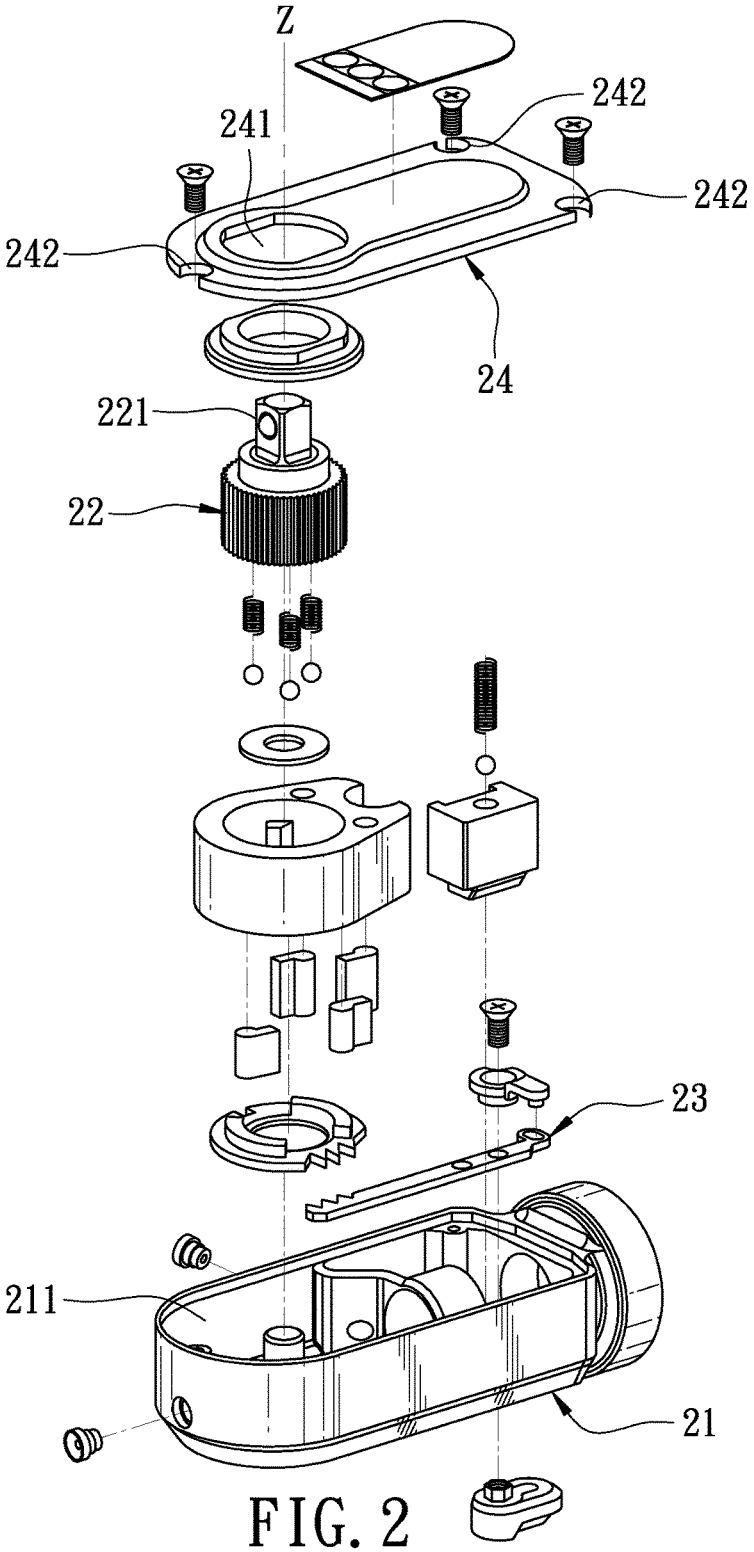
FIG. 2 PRIOR ART
FIG. 2 is a fragmentary exploded bottom perspective view of a pneumatic ratchet drive wrench disclosed in U.S. Pat. No. 6,578,643.
Figure 3:
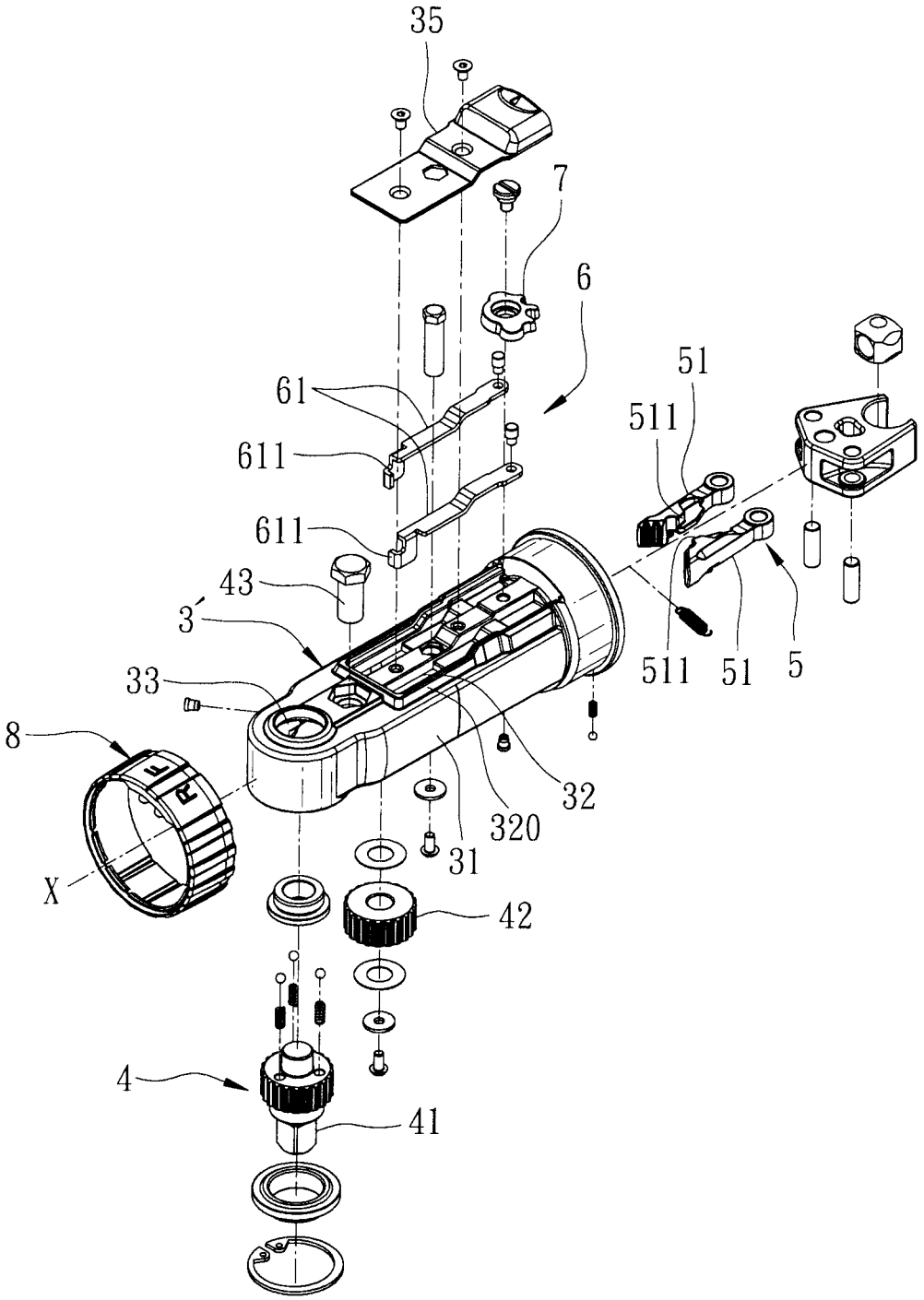
FIG. 3 is a fragmentary top perspective view of the preferred embodiment of a pneumatic tool according to this invention.
Figure 4:
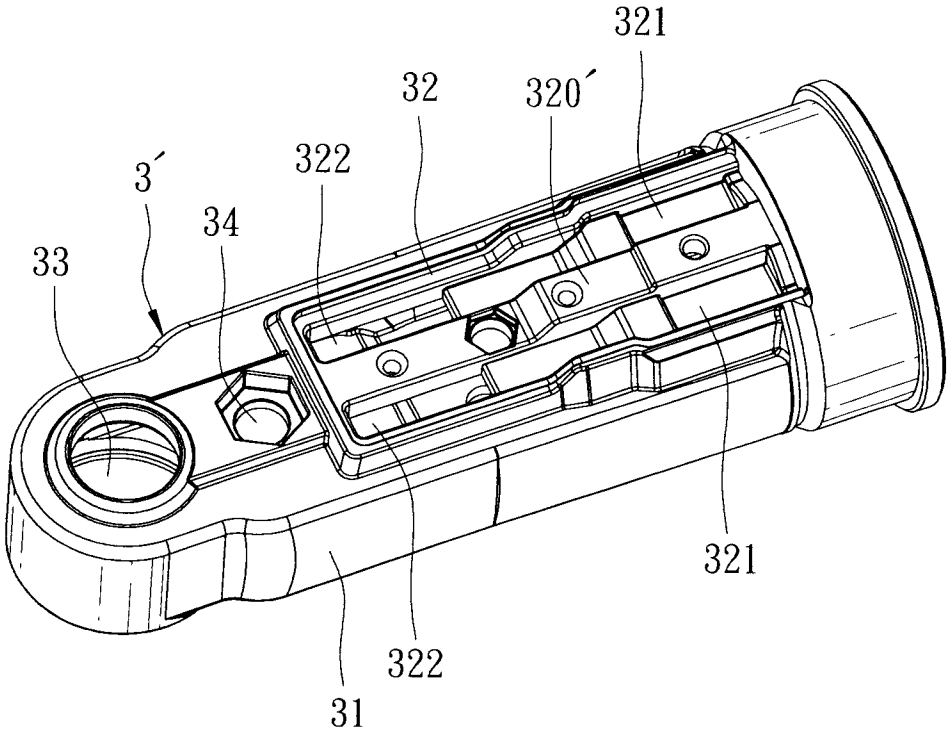
FIG. 4 is a top perspective view of a front handle section of a handle body of the preferred embodiment.
Figure 5:
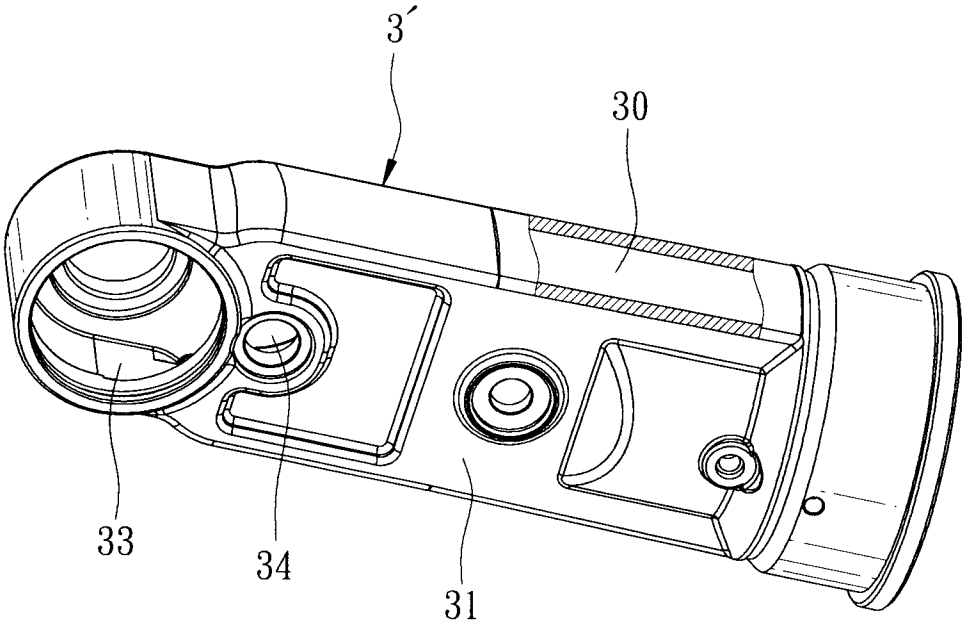
FIG. 5 is a bottom perspective view of the front handle section of the preferred embodiment.
Figure 6:
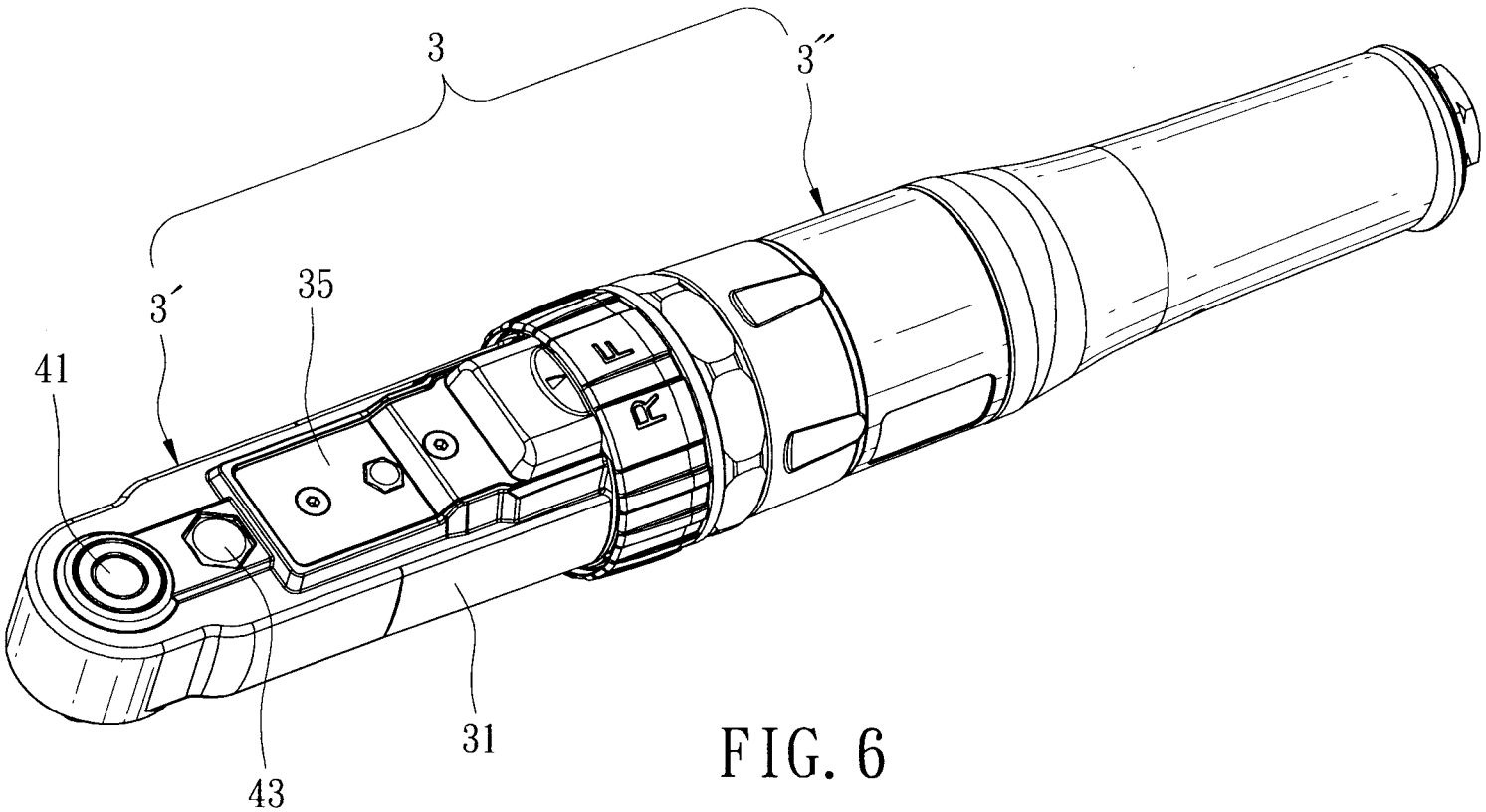
FIG. 6 is a top perspective view of the preferred embodiment.
Figure 7:
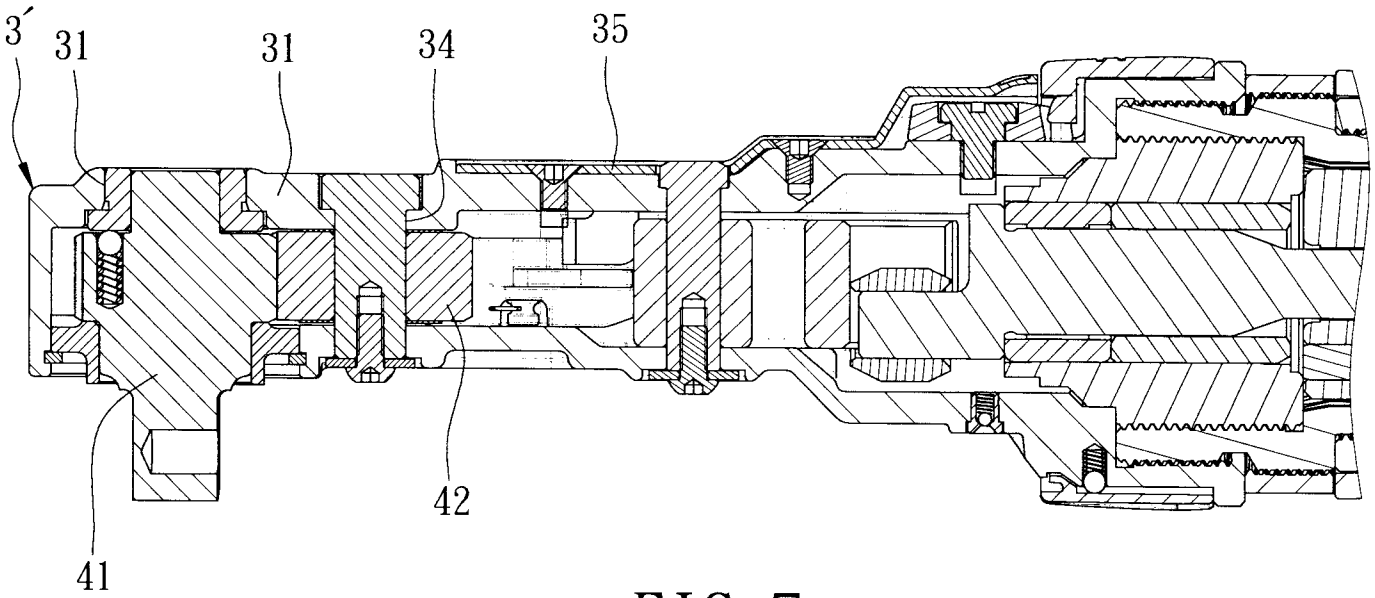
FIG. 7 is a fragmentary sectional view of the preferred embodiment.

Referring to FIGS. 3, 4, 5, and 6, the preferred embodiment of a pneumatic tool according to this invention includes a handle body 3 (see FIG. 6) having a front handle section 3' and a rear handle section 3" (see FIG. 6), an output unit 4, a driving unit 5, and a switching unit 6.

The front handle section 3 includes a surrounding wall 31 defining an axial space 30 that has a central axis (X), amounting unit 32 formed integrally on a top surface of the surrounding wall 31, a through hole 33 formed vertically through the surrounding wall 31 and in spatial communication with the axial space 30, a pinion hole 34 formed vertically through the surrounding wall 31 and disposed between the through hole 33 and the mounting unit 32, and a plate 35. In this embodiment, the mounting unit 32 includes a fence 320 (see FIG. 3) extending from the top surface of the surrounding wall 31, and a spacer 320' (see FIG. 4) extending from the top surface of the surrounding wall 31 and disposed in the fence 320 to divide a space defined by the fence 320 into two slide slots 321 (see FIG. 4) that are parallel and adjacent to each other. The top surface of the surrounding wall 31 is formed with two passage holes 322 each in spatial communication with the axial space 30 and the corresponding slide slot 321. The plate 35 is disposed fixedly on the surrounding wall 31 by lock bolts for covering the space defined by the fence 320.

The output unit 4 is mounted in the through hole 33, and includes a driving head 41, a pinion 42 geared to the driving head 41 such that rotation can be transferred from the pinion 42 to the driving head 41, and a pivot pin 43 for mounting the pinion 42 pivotally within the pinion hole 34.

The driving unit 5 is mounted into the axial space 30 through a rear end of the handle body 3 for driving the output unit 4, and includes two racks 51 each having a projection 511. The racks 51 are driven pneumatically in a known manner to move reciprocally relative to the handle body 3 in opposite directions. Each of the racks 51 is movable to engage the pinion 42 such that only one rack 51 can engage the pinion 42 at a time. When one of the racks 51 engages the pinion 42, the pinion 42 rotates in a direction. When the other of the racks 51 engages the pinion 42, the pinion 42 rotates in an opposite direction. Since the structure and operation of the driving unit 5 are known in the art, further description thereof will be omitted.

The switching unit 6 is mounted in the mounting unit 32, is confined between the plate 35 and the surrounding wall 31, and is operable to change the rotational direction of the driving head 41. In this embodiment, the switching unit 6 includes two pushing members 61 received respectively and movably within the slide slots 321 in the mounting unit 32. Each of the pushing members is movable reciprocally relative to the handle body 3 between a pushing position and a releasing position. The pushing members 61 are interconnected in a known manner such that, through manual operation, when one of the pushing members 61 is moved forwardly relative to the handle body 3, the other of the pushing members 61 is moved rearwardly relative to the handle body 3. For example, the pushing members 61 are connected respectively and pivotally to two opposite sides of a swingable switching member 7 (see FIG. 3) geared to an operating member 8 (see FIG. 3), such that the operating member can be operated manually to rotate to thereby swing the switching member 7 reciprocally for driving movement of the pushing members 61. In this embodiment, each of the pushing members 61 has a pushing portion 611 extending into the axial space 30 through the corresponding passage hole 322 such that, when it is moved to the pushing position, the pushing portion 611 comes into contact with the projection 511 of the corresponding rack 51 so as to prevent engagement of the corresponding rack 51 with the pinion 42, and when it is moved to the releasing position, the pushing portion 611 is spaced apart from the projection 511 of the corresponding rack 51 so as to allow for engagement of the corresponding rack 51 with the pinion 42.

In view of the above, there is no need to form a U-shaped opening in the front handle section 3' for permitting the output unit 4 and the driving unit 5 to be mounted into the handle body 3 therethrough, or a chamber for receiving the output unit 4 and the driving unit 5, so that the structural stability of the pneumatic tool is promoted. Furthermore, since the plate 35 is used solely for covering the space defined by the fence 320, it does not need to be formed with any through hole in the plate 35 for extension of the driving head 41 or the pinion 42. Consequently, time, cost, and precision for making the plate 35 can be reduced largely.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A handle body adapted for use in a pneumatic tool, the pneumatic tool including an output unit having a driving head, a driving unit for driving the output unit, and a switching unit operable to change the rotational direction of the driving head, said handle body comprising:

a surrounding wall having a top surface and defining an axial space that has a central axis and that is adapted to be shaped to permit the driving unit to be mounted therein;

a mounting unit formed integrally on said top surface of said surrounding wall and defining at least one mounting space that is adapted to be shaped to permit the switching unit to be mounted therein; and a through hole formed vertically through said surrounding wall and in spatial communication with said axial space, said through hole being adapted to be shaped to permit the output unit to be mounted therein, said through hole having no laterally extending openings which extend through said surrounding wall.

2. The handle body as claimed in claim 1, further comprising a plate disposed fixedly on said top surface and adapted for confining the switching unit between said surrounding wall and said plate.

3. A pneumatic tool comprising:

a handle body including a surrounding wall having a top surface and an axial space that has a central axis, a mounting unit disposed at said top surface of said surrounding wall, and a through hole formed vertically through said surrounding wall and in spatial communication with said axial space;

an output unit mounted in said through hole and including a driving head, and a pinion geared to said driving head such that rotation can be transferred from said pinion to said driving head;

a driving unit mounted in said axial space in said handle body for driving said output unit, said driving unit including two racks driven pneumatically to move reciprocally relative to said handle body in opposite directions, each of said racks being movable to engage said pinion such that, when one of said racks engages said pinion, said pinion rotates in a direction, and when the other of said racks engages said pinion, said pinion rotates in an opposite direction; and a switching unit mounted in said mounting unit and operable to change the rotational direction of the driving head, said switching unit including two pushing members each movable reciprocally relative to said handle body between a pushing position and a releasing position such that, when one of said pushing members comes into contact with one of said racks to prevent said one of said racks from engaging said pinion, the other of said pushing members is spaced apart from the other of said racks to allow the other of said racks to engage said pinion.

4. The pneumatic tool as claimed in claim 3, wherein said handle body further includes a plate disposed fixedly on said top surface and adapted for confining the switching unit between said surrounding wall and said plate.

5. The pneumatic tool as claimed in claim 3, wherein said mounting unit includes a fence extending from said top surface of said surrounding wall of said handle body, and a spacer extending from said top surface of said surrounding wall of said handle body and disposed in said fence to divide a space defined by said fence into two slide slots, said pushing members being received respectively and movably within said slide slots.

6. The pneumatic tool as claimed in claim 5, wherein:

said top surface of said handle body is formed with two passage holes each in spatial communication with said axial space in said handle body and a respective one of said slide slots;

each of said racks has a projection; and each of said pushing members has a pushing portion extending into said axial space in said handle body through a corresponding one of said passage holes such that, when a corresponding one of said pushing members is at said pushing position, said pushing portion is in contact with said projection of a corresponding one of said racks to prevent said corresponding one of said racks from engaging said pinion, and when said pushing portion is spaced apart from said projection of said corresponding one of said racks, engagement of said corresponding one of said racks with said pinion is allowed.

7. The pneumatic tool as claimed in claim 3, wherein said surrounding wall of said handle body further has a pinion hole formed vertically therethrough and disposed between said through hole and said mounting unit, said pinion being disposed pivotally within said pinion hole.

* * * * *